US006584802B1

(12) United States Patent
Cofield et al.

(10) Patent No.: US 6,584,802 B1
(45) Date of Patent: Jul. 1, 2003

(54) COOLING APPARATUS EMPLOYING CARBON DIOXIDE

(76) Inventors: Monty J. Cofield, 21921 100th Ave. SE., Kent, WA (US) 98031; Scott B. Wheeler, 1060 Kent Des Moines Rd., Des Moines, WA (US) 98198

( * ) Notice: Subject to any disclaimer, the term of this patent is extended or adjusted under 35 U.S.C. 154(b) by 0 days.

(21) Appl. No.: 10/123,640

(22) Filed: Apr. 16, 2002

(51) Int. Cl.[7] ..... F25J 1/00
(52) U.S. Cl. ..... 62/602; 62/384
(58) Field of Search ..... 62/384, 388, 602, 62/603

(56) References Cited

U.S. PATENT DOCUMENTS

| | | | | | |
|---|---|---|---|---|---|
| 1,997,151 | A | * | 4/1935 | Maiuri | 62/602 |
| 2,096,255 | A | * | 10/1937 | McIlrath | 62/114 |
| 3,757,367 | A | * | 9/1973 | Campbell | 62/603 |
| 4,111,671 | A | * | 9/1978 | Williamson | 62/603 |
| 4,145,894 | A | * | 3/1979 | Frank et al. | 62/344 |
| 4,399,658 | A | * | 8/1983 | Nielsen | 62/50.2 |
| 5,566,553 | A | * | 10/1996 | Gibot et al. | 62/603 |
| 5,924,181 | A | * | 7/1999 | Takasugi | 27/11 |
| 6,023,941 | A | * | 2/2000 | Rhoades | 62/603 |
| 6,109,058 | A | * | 8/2000 | Franklin, Jr. | 62/384 |

* cited by examiner

*Primary Examiner*—William E. Tapolcai
(74) *Attorney, Agent, or Firm*—Stratton Ballew PLLC

(57) ABSTRACT

A cooling apparatus and method that employs carbon dioxide ($CO_2$) to cool, refrigerate or freeze the contents of a cooler or container. The cooling apparatus is preferably a portable device with a selfcontained refrigeration system that cools indirectly with liquid carbon dioxide, utilizing the sublimation of $CO_2$ "dry-snow" or "snow" to self-regulate the flow of the $CO_2$ refrigerant in the system. The cooling apparatus includes a liquid carbon dioxide reservoir that contains a quantity of liquified carbon dioxide. A regulator for reducing the pressure of the liquid carbon dioxide flowing through the regulator, connects to the liquid carbon dioxide reservoir. The cooling coil preferably terminates with a cooling coil to vent to an atmosphere. A flow of carbon dioxide is established by a movement of the carbon dioxide from the liquid carbon dioxide reservoir, through the regulator, into the cooling coil, and to the atmosphere. A plurality of solid carbon dioxide particles formed by a freezing of the carbon dioxide within the cooling coil, and the flow of the carbon dioxide into the bleeder tube substantially blocked by the plurality of solid carbon dioxide particles within the cooling coil, the plurality of solid carbon dioxide particles sublimate-able to allow a re-establishment of the flow of carbon dioxide from the regulator.

7 Claims, 10 Drawing Sheets

COOLING APPARATUS EMPLOYING CARBON DIOXIDE

TECHNICAL FIELD

The invention relates to a cooling apparatus and method that uses carbon dioxide ($CO_2$) to cool, refrigerate or freeze; and more particularly to a portable device preferably embodied in a selfcontained refrigeration system that cools indirectly with liquid carbon dioxide, utilizing the sublimation of $CO_2$ "dry-snow" to self-regulate the flow of the $CO_2$ refrigerant in the system.

BACKGROUND OF THE INVENTION

Carbon dioxide ($CO_2$), in its liquid and solid forms is employed in many commercial, industrial and to some extent residential refrigeration, freezing and cooling applications. Under normal, atmospheric pressure, $CO_2$ can only exist as a gas at ambient temperatures or a chilled solid that sublimates into the gas at minus 109.3 degrees, Fahrenheit. However, if pressurized, gaseous $CO_2$ forms a liquid with a water-like viscosity. $CO_2$ is a desirable refrigerant because it is colorless and typically odorless. It is also chemically inert under ordinary conditions.

Because $CO_2$ is inexpensive to manufacture and has little potential for adverse environmental impact in small quantities, it is often employed as a disposable refrigerant. Several U.S. patent references utilize the unique properties of $CO_2$ in re-chargeable types of refrigeration, freezing and cooling systems.

U.S. Pat. No. 3,561,226 Rubin describes a refrigeration system for vehicles that includes a minimum of moving parts. Rubin '226 employs a liquid reservoir of carbon dioxide to fill a set of containers with densely packed "snow." The filling of the container with carbon dioxide is activated by a timed solenoid valve, or alternatively a manual valve. $CO_2$ vapor passes out of each container, while $CO_2$ snow is trapped by a screen, backing up the snow into the container. A portable refrigeration system is needed that better utilizes liquid $CO_2$ to more evenly generate a self regulated refrigeration effect, rather than the expansion of liquid $CO_2$ into a trough or bin container.

Similarly, to Rubin '226, U.S. Pat. No. 4,704,876 to Hill shows a cryogenic refrigeration system that uses carbon dioxide snow formed by spraying $CO_2$ through a series of nozzles within a snow collection compartment. The compartment is open to a refrigerated space, below. This feature is undesirable because the cargo is directly exposed to the frigid $CO_2$ snow, which can result in damage to the cargo, especially if it is perishable fruits or vegetables. Control is achieved with temperature sensors in the refrigerated compartment that opens a valve to deliver more liquid $CO_2$ to the nozzles, or alternatively by manual valving. Hill '876 also requires that the nozzles remain "free and open" of solid $CO_2$.

U.S. Pat. No. 4,381,649 to Franklin discloses a $CO_2$ snow producer that includes spray nozzles for directing jets of liquid carbon dioxide onto a surface of a heat exchanger. The pressure at the nozzles of Franklin '649 is approximately 75 psi and the temperature in the supply line to the nozzle is maintained near minus 69° F., as a goal. From the Franklin disclosure, control of the system is achieved through what appears to be a manual control valve at the tank of liquid $CO_2$.

Several problems are encountered in Ruben '226, Franklin '649 and Hill '876 when the temperature feedback is disabled or malfunctions, the timer is set incorrectly, or the operator fails to activate or deactivate the system as needed. Direct, on/off control by an operator is especially unreliable in that the system can over-cool, with an over production of $CO_2$ snow risking damage to the refrigerated contents or to the operators. Under cooling can also cause undesirable effects in the unwanted thawing or spoiling of refrigerated articles. A $CO_2$ refrigeration system is needed that employs a simple design but eliminates the need for an on/off $CO_2$ control valve that directly meters the release of $CO_2$ into a refrigerated space.

DETAILED DESCRIPTION OF SPECIFIC EMBODIMENTS

Figure 1:
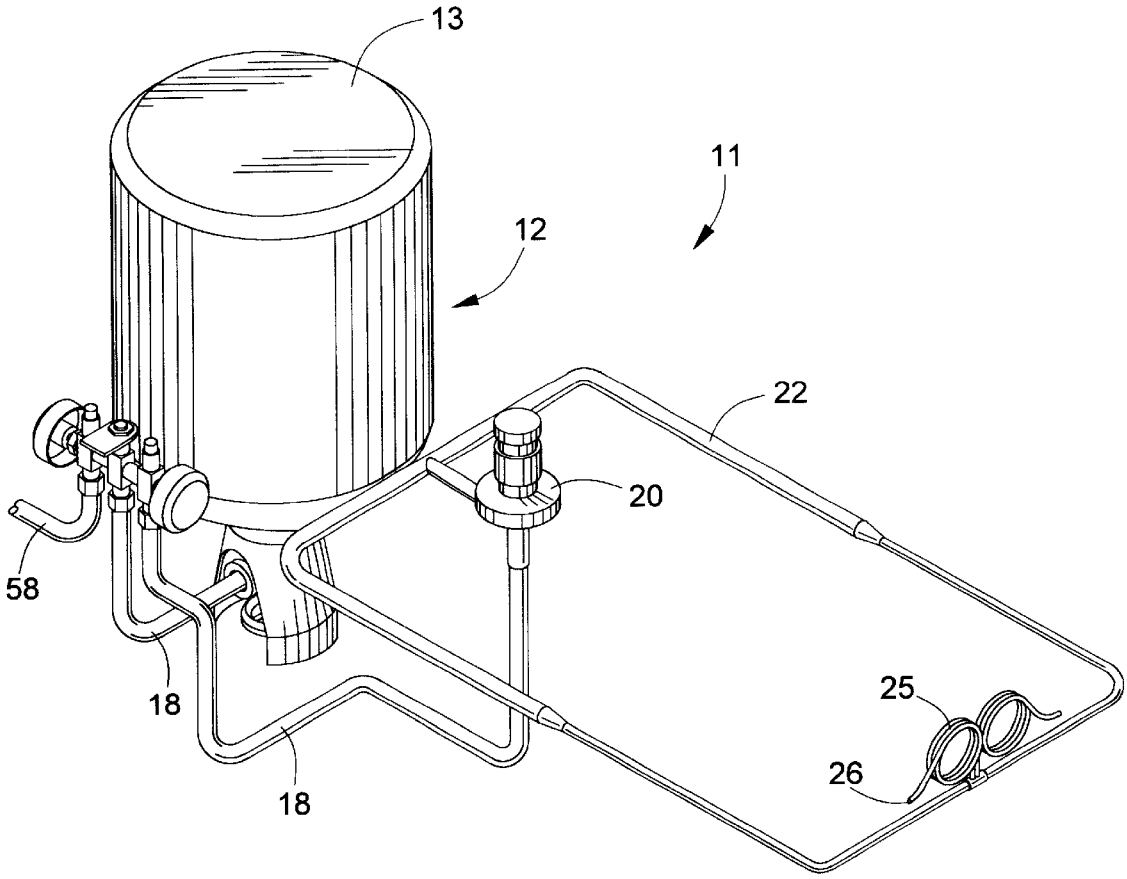
FIG. 1 is a perspective view of a cooling apparatus, according to an embodiment of the invention.

The present invention, as shown in FIGS. 1 through 10, provides a simple but effective cooling apparatus that refrigerates or freezes with carbon dioxide ($CO_2$). FIG. 1 shows a preferred embodiment of a refrigeration system 11., including features of the present invention. For its elemental components, the refrigeration system includes a $CO_2$ source 12, which is preferably a tank 13 of pressurized $CO_2$. The $CO_2$ is stored within the tank in a liquid state. Under pressure, $CO_2$ is a liquid at typical room temperatures. A supply line 18 conveys the $CO_2$ from the tank to a regulator 20. The regulator feeds the $CO_2$ to a cooling coil 22. The regulator serves to "throttle," or reduce the pressurized $CO_2$ from a tank pressure to a cooling coil static pressure. Preferably, the evaporator is tapered as it extends from the regulator, most preferably terminating with a bleeder tube 25. The bleeder tube has an open end 26 that allows the $CO_2$ to escape.

The cooling coil 22 is most preferably manufactured from a copper tubing, because of its high heat transfer and malleability. Other metallic materials are considered, typically those with high heat transfer. Plastic materials having good heat conductive properties could also be utilized because of their flexibility, especially in clothing applications of the present invention.

Figure 2A:
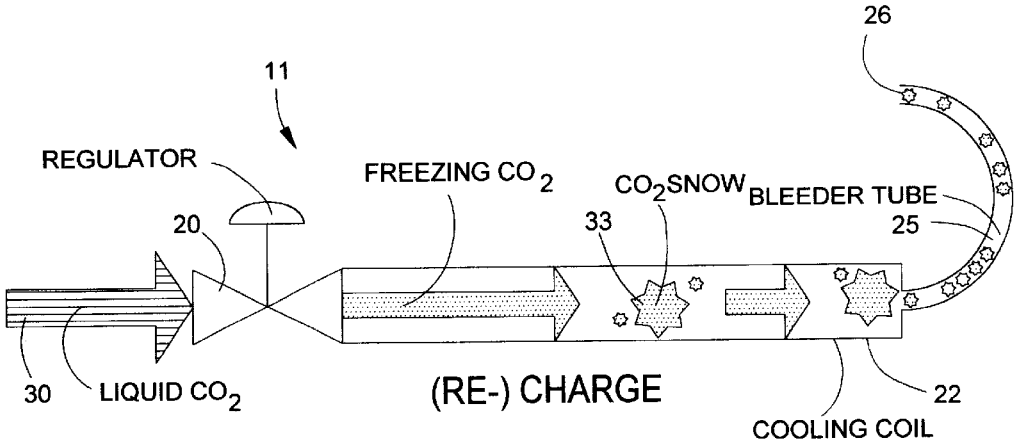
FIG. 2A is a schematic of a step in a refrigeration system cycle, according to an embodiment of the invention.
Figure 2B:
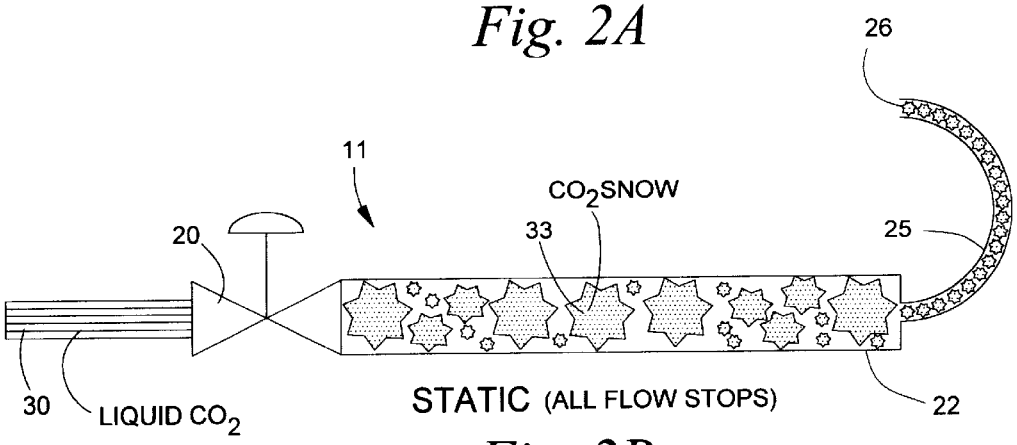
FIG. 2B is a schematic of a step in a refrigeration system cycle, according to an embodiment of the invention.
Figure 2C:
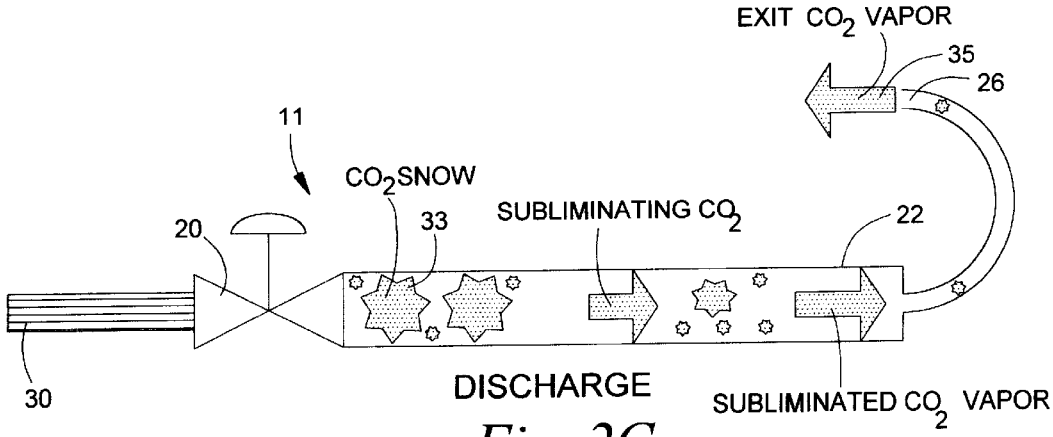
FIG. 2C is a schematic of a step in a refrigeration system cycle, according to an embodiment of the invention.

The refrigeration system 11 basically includes three operational steps to provide a cooling cycle. This cooling or refrigeration cycle is schematically represented in FIGS. 2A, 2B and 2C, which all show a liquid $CO_2$ 30 metered by the regulator 20, into the cooling coil 22. In each schematic, the cooling coil is shown terminating with the bleeder tube 25, as preferred. As discussed above, the liquid $CO_2$ is supplied by a $CO_2$ source 12, which is preferably a tank 13, as shown in FIG. 1.

The first step or stage of the cooling cycle is shown in FIG. 2A. This first stage is a "(RE-) CHARGE" of the cooling coil 22 with a $CO_2$ snow 33. The liquid $CO_2$ 30, as supplied by the $CO_2$ source 12, enters the cooling coil from the regulator 20. The regulator reduces the pressure of the liquid $CO_2$ to an initial cooling coil pressure. Because the cooling coil is open to the atmosphere through the bleeder tube 25, the initial cooling coil pressure is approximately the ambient pressure external to the refrigeration system 11. The regulator is preferably a constant outlet pressure type of expansion valve, as manufactured by the Climate and Industrial Controls division of Parker-Hannifin, of Broadview, Ill., USA, for use with R-744 (carbon dioxide).

The regulator 20 throttles the pressure of the liquid $CO_2$ 30 into the cooling coil 22 to a pre-set "cut-off" pressure. The cut-off pressure is most preferably adjustable at the regulator to allow fine tuning of the cooling effects of the refrigeration system 11. Upon entering the cooling coil, the $CO_2$ instantaneously changes state, and freezes or "flash-freezes" into the $CO_2$ snow 33, or dry snow, and the refrigeration system approaches the "static" condition, as illustrated in FIG. 2B.

With the charge of liquid $CO_2$ 30 flash-freezing within the cooling coil 22, the cooling coil and the bleeder tube 25 are quickly plugged. As a result, the cooling coil pressure of the $CO_2$ within the cooling coil quickly rises from the initial cooling coil pressure to a shut-off pressure, which is above the set point of the regulator. Once the shut-off pressure is passed, the flow of the liquid $CO_2$ into and through the cooling coil stops, as shown in FIG. 2B. This static condition is typically short lived, the exact duration dependent upon the cooling or freezing load of the refrigeration system and also the set-point or cut-off pressure of the regulator.

As shown in FIG. 2C, the $CO_2$ snow 33 slowly warms to form a sublimated $CO_2$ vapor 34 within the cooling coil 22. This sublimation action pressurizes the cooling coil to an emission pressure at which the bleeder tube 25 is forced to release a small charge of exit $CO_2$ vapor 35. This third stage is a "discharge" of the $CO_2$ contents of the cooling coil. As the $CO_2$ snow 33 sublimates and escapes from the cooling coil through the bleeder tube, the pressure in the cooling coil approaches the initial cooling coil pressure.

When the escaping $CO_2$ vapor causes the pressure within the cooling coil 22 to drop below the shut-off pressure, the regulator opens to recharge the cooling coil with $CO_2$. Upon re-charging, as shown in FIG. 2A, the bleeder tube 25 immediately re-plugs and the refrigeration system 11 again approaches equilibrium. At equilibrium or static condition, as shown in FIG. 2B, the $CO_2$ regulator valve re-closes and the charge of $CO_2$ snow 33 once again begins to sublimate within the cooling coil. The simple cycle of charging and discharging continues as long as the liquid $CO_2$ is supplied to the regulator. The cooling action of the refrigeration system 11 is realized primarily from the sublimation of the $CO_2$ snow, and to a lesser extent, from the release of the cool exit $CO_2$ vapor 35.

The refrigeration system utilizes the sublimation of the $CO_2$ snow 33 to self-regulate the flow of refrigerant in the system. The configuration of the cooling coil 22 and sizing of the bleeder tube 25 primarily dictates the general capacity and cooling properties of the system. A simple loop of copper tubing as shown in FIG. 1, is a preferred configuration for the cooling coil. The diameter of the cooling coil is most preferably reduced as it travels further away from the regulator. This gives a more even distribution to the $CO_2$ snow within the cooling coil and helps minimize single point obstructions by the $CO_2$ snow, but instead encourages plugs of $CO_2$ to form at several points along the cooling coil.

Specific and fine control of cooling rate for a given refrigeration system 11 having the specific features of the present invention is preferably achieved through the manual adjustment of shut-off pressure at the regulator 20. Alternative, automatic feedback mechanisms for adjusting the shut-off pressure of the regulator are considered with the scope of the invention. However, these alternative feedback mechanisms would not be conventional, direct on-off feedbacks to the regulator. Instead the feedback would only change the shut-off pressure of the regulator and so increase or reduce the "balance" pressure at which the regulator charges or re-charges the cooling coil 22.

By increasing the balance pressure of the regulator 20, the refrigeration system 11, namely the cooling coil 22 is forced to "discharge" at the emission pressure, as shown in FIG. 2C, before such a discharge would occur at a lower balance pressure. And so, at the higher balance pressure, the refrigeration system cycles more frequently, using more liquid $CO_2$ 30 and so generates more $CO_2$ snow 33 and withdraws more heat to sublimate the $CO_2$ snow. Conversely, at a lower regulator balance pressure, less liquid $CO_2$ is forced into the cooling coil and the "static" condition of the refrigeration system, as shown in FIG. 2B is retained for a longer period as the emission pressure is more slowly approached, and so slows the cooling effects of the system, which uses less liquid $CO_2$. Therefore, the balance pressure of the regulator can be selectively increased or decreased to change the cooling effects of the refrigeration system.

Changing the "balance pressure" of the refrigeration system 11 can be accomplished by manual adjustment or by automatic adjustment of the regulator 20. If the temperature within the cooling compartment 47 is above a set point, the regulator can be adjusted to raise the balance pressure and increase the cooling effects of the refrigeration system. Conversely, if the temperature within the cooling compartment is below the set point, the regulator can be adjusted to lower the balance pressure and decrease the flow of liquid $CO_2$ 30 through the regulator, to decrease system cooling.

Another controlling aspect of the refrigeration system 11 performance is the selection of the bleeder tube 25. As discussed above, the bleeder tube is a component of the cooling coil 22 located downstream from the regulator 20. The bleeder tube is most preferably a small diameter tube with an approximate inner diameter of approximately 1/16th of an inch, and most preferably manufactured from a copper tubing. Bleeder tubes ranging in diameter from 1/32nd of an inch to a 1/4th inch can be preferably employed, or alternatively any diameter sufficient to retain the $CO_2$ snow and prevent its free flow out of the cooling coil. A single bleeder tube can be utilized, or any multiple of bleeder tubes. However, two bleeder tubes connected to the cooling coil as shown in FIGS. 1 and 3 through 6 are a most preferred configuration. The bleeder tube releases the exit $CO_2$ vapor 35 from the cooling coil. This release of vapor is slow and accurately adjustable, due to the unique physical properties of the $CO_2$, in conjunction with the self regulating properties of the refrigeration system. To aid in maintaining the bleeder tubes free from obstructions or impurities, possibly present within the $CO_2$, a line drier of a conventional type can be installed in the refrigeration system, preferably between the regulator and the tank 13.

The refrigeration system 11 of the present invention can be employed in many embodiments. "Lunch box" sized systems are considered by the inventor, as well as long haul trailers, cargo containers, warehouses, and rail cars. The portability of the refrigeration system is enhanced by its ability to function for a single discharge cycle even when disconnected from the $CO_2$ source 12. This alternative embodiment would be very convenient for a vest, hat, helmet, space suit, environment suit or firefighting suit. The supply line 18 could be disengaged from the $CO_2$ source after a charge of liquid $CO_2$ is received into the cooling coil 22. The cooling coil slowly discharges the exit $CO_2$ vapor 35, as shown in FIG. 2C, until all the $CO_2$ snow 33 has sublimated. Depending upon the length of the cooling coil, the amount of $CO_2$ snow within and the cooling load, the discharge cycle could be designed for any time period, from a few minutes to several hours, or days if desired.

For the present invention, the cooling coil 22 itself primarily controls the quantity of liquid $CO_2$ 30 used by the refrigeration system 11. The regulator 20 is employed to "fine tune" the quantity of $CO_2$ used, but the cooling load served by the cooling coil is the primary activity that pulls $CO_2$ through the system, as the cooling coil is warmed and the $CO_2$ snow 33 melts within. The sublimation of the $CO_2$ snow within the cooling coil controls the flow of the $CO_2$ refrigerant pressure, at the regulator 20 pressure, which is maintained at a safe, low pressure of approximately 20 to 60 psig, as compared to conventional, snow generating $CO_2$ systems with energetic nozzles that blow $CO_2$ snow flashed from the pressurized liquid into containers or troughs at pressures of 300 psig. Most importantly, these conventional systems require manual on/off controls or rely upon direct temperature feedback controls, which can malfunction and are typically quite expensive. For the present invention, the pressure downstream of the regulator controls the flow of $CO_2$ through the regulator, eliminating the need for a solenoid, a timer or a temperature dependent control.

Figure 3:
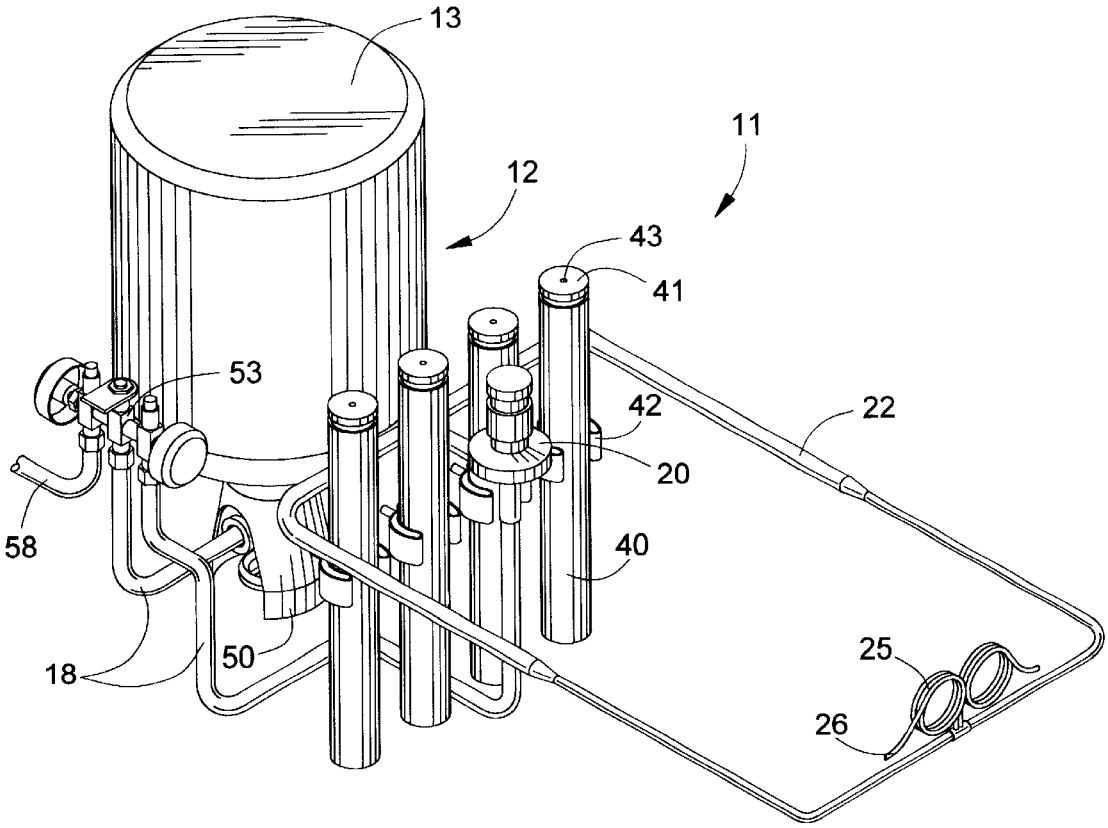
FIG. 3 is a perspective view of a cooling apparatus, according to an embodiment of the invention.

The refrigeration system 11 can also be employed to manufacture water ice. FIG. 3 shows a plurality of ice maker tubes 40 attached to the cooling coil. The ice maker tubes are simply water filled cylinders that receive a stopper 41 at each end of the tube. The tube is filled with water and placed within a bracket 42 mounted upon the cooling coil. The cooling action of the $CO_2$ within the cooling coil quickly freezes the water within. The bracket and the ice maker tubes are preferably made of a metal, such as aluminum, which does not impart a flavor to the ice, but conducts heat very well.

Additionally, the ice maker tubes 40 most preferably include a slight taper in their construction. This slight taper allows the ice to release from the tube more easily. After filling one or more of the ice maker tubes with water, the ice maker tube is stoppered and placed in one of the brackets 42. After a short period of operation of the refrigeration system, the water within the ice maker tube freezes. The ice maker tube is then removed from the bracket and the stoppers 41 are removed, and the manufactured ice slides out of the ice maker tube. A relief hole 43 is preferably included in the stopper mounted at the top of the ice maker tube, allowing air to escape from the tube above the ice as it freezes and additionally only require the bottom stopper to be removed to extract the ice from the ice maker tube.

As an additional alternative, for the purpose of making ice with the present invention, the plurality of ice maker tubes 40 can be mounted within an array. By interconnecting the ice maker tubes, they can be more easily handled, especially if a primary purpose of the refrigeration system 11 is to manufacture water ice.

As discussed above, the present invention provides a refrigeration system that employs liquid carbon dioxide to directly and indirectly refrigerate or freeze the contents of an enclosure or container. The cooling system can be completely self-contained and made easily portable. An additional preferred embodiment of the refrigeration system 11 of the present invention is shown in FIGS. 3 through 10. In the preferred embodiment shown, the container housing the refrigeration system is an ice chest 45.

Most preferably, the ice chest includes a tank compartment 46 and a cooling compartment 47. The tank compartment includes the $CO_2$ source 12, such as the tank 13. The tank contains liquid $CO_2$ under pressure. The tank can be insulated with a material such as a closed cell foam, or the tank can be vacuum insulated by virtue of a double walled construction.

Any container with the ability to store liquified $CO_2$ 30 can be employed as the $CO_2$ source 12 for the present invention. The preferred tank 13 is shown to contain approximately one U.S. gallon in volume. This quantity of liquid $CO_2$ is enough to maintain the cooling compartment 47 of the ice chest 45, having an approximate size of 50 quarts as shown in FIGS. 4 through 10, in a refrigerated condition for days, the exact time depending upon factors such as the temperature of the air outside the ice chest, the quantity of articles placed into the ice chest and how frequently the ice chest is opened.

The tank 13 is preferably a cylindrical shape of a conventional seamless aluminum, or alternatively a welded steel, and most preferably meets or exceeds all applicable regulations relating to tank construction and in-service testing. Such tank standards are well known in the industry. For the $CO_2$ tank employed in a preferred embodiment of the cooling system, the U.S. Department of Transportation (DOT) has several standards that may apply, depending upon the construction, size and service requirements of the tank. DOT-3A1800, DOT-3AX1800, DOT-3AA1800, DOT-3AAX1800, DOT-3, DOT-3E1800, DOT-3T1800, DOT-3HT2000, DOT-39 and DOT-3AL1800, are examples of standards that may apply.

Figure 4:
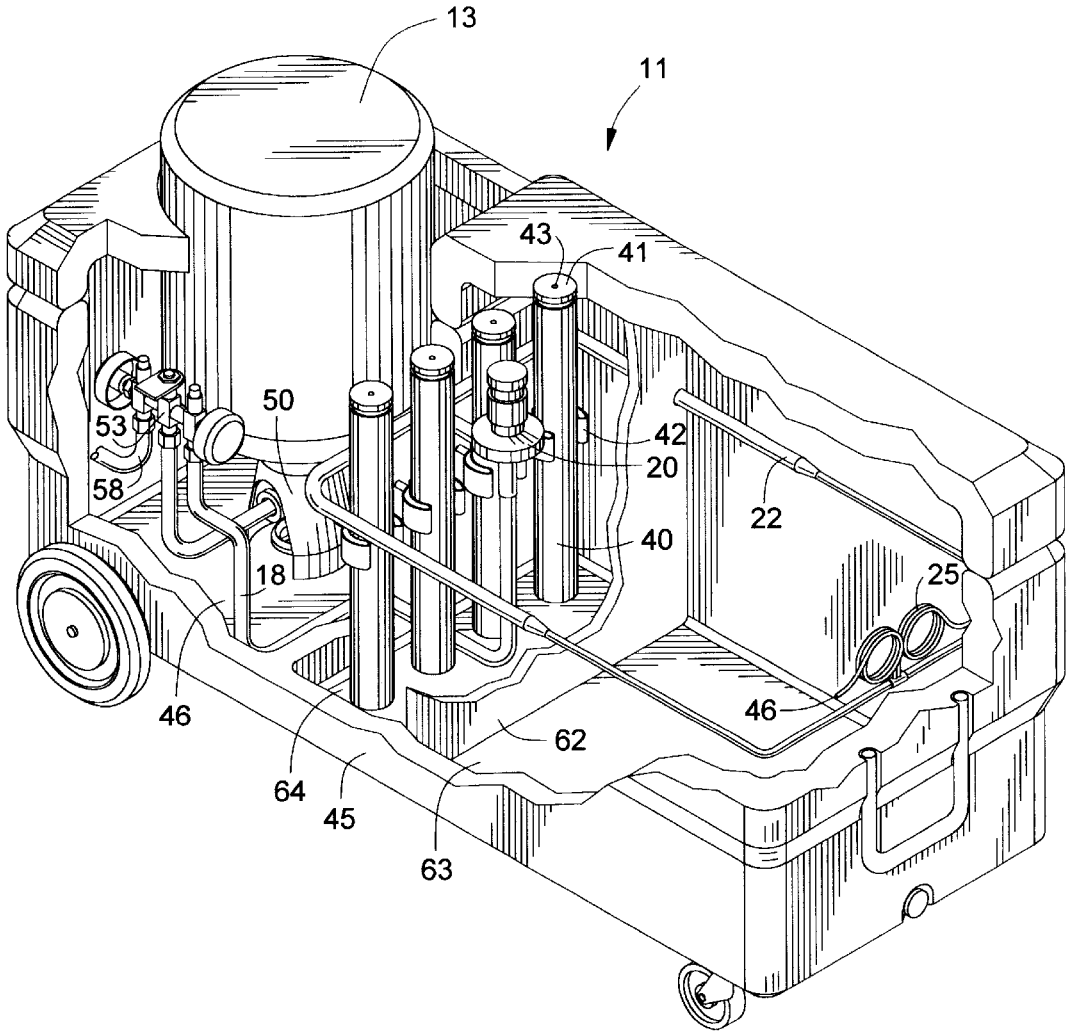
FIG. 4 is a partially sectioned perspective view of a cooling apparatus, according to an embodiment of the invention.
Figure 5:
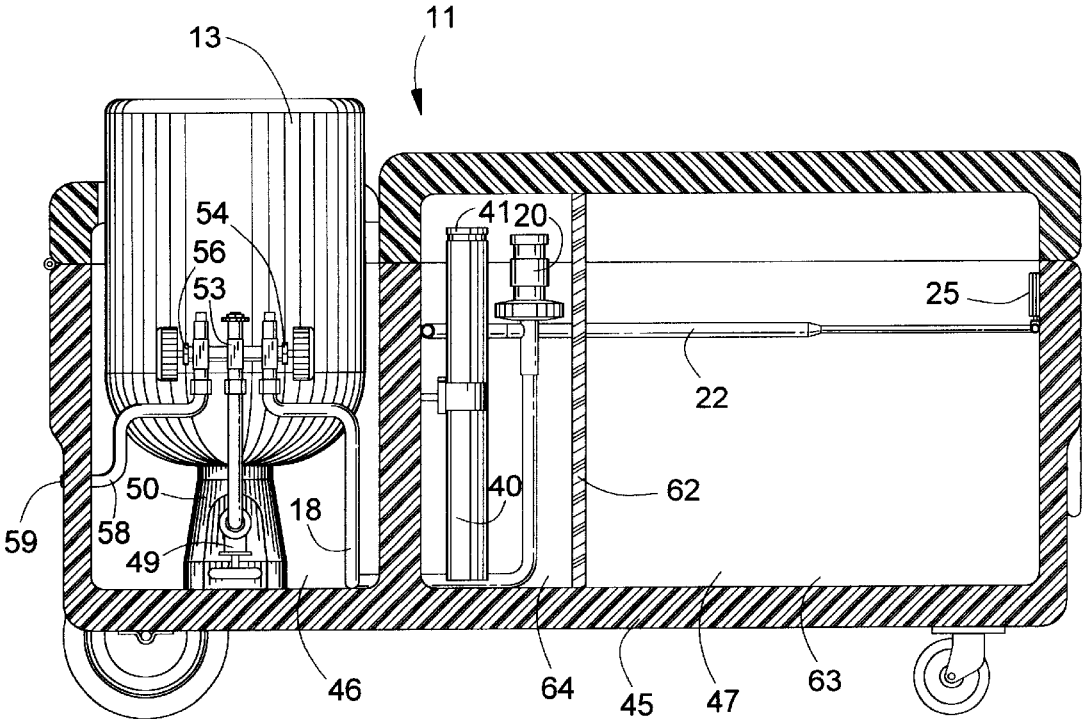
FIG. 5 is a partially sectioned view of a cooling apparatus, according to an embodiment of the invention.
Figure 6:
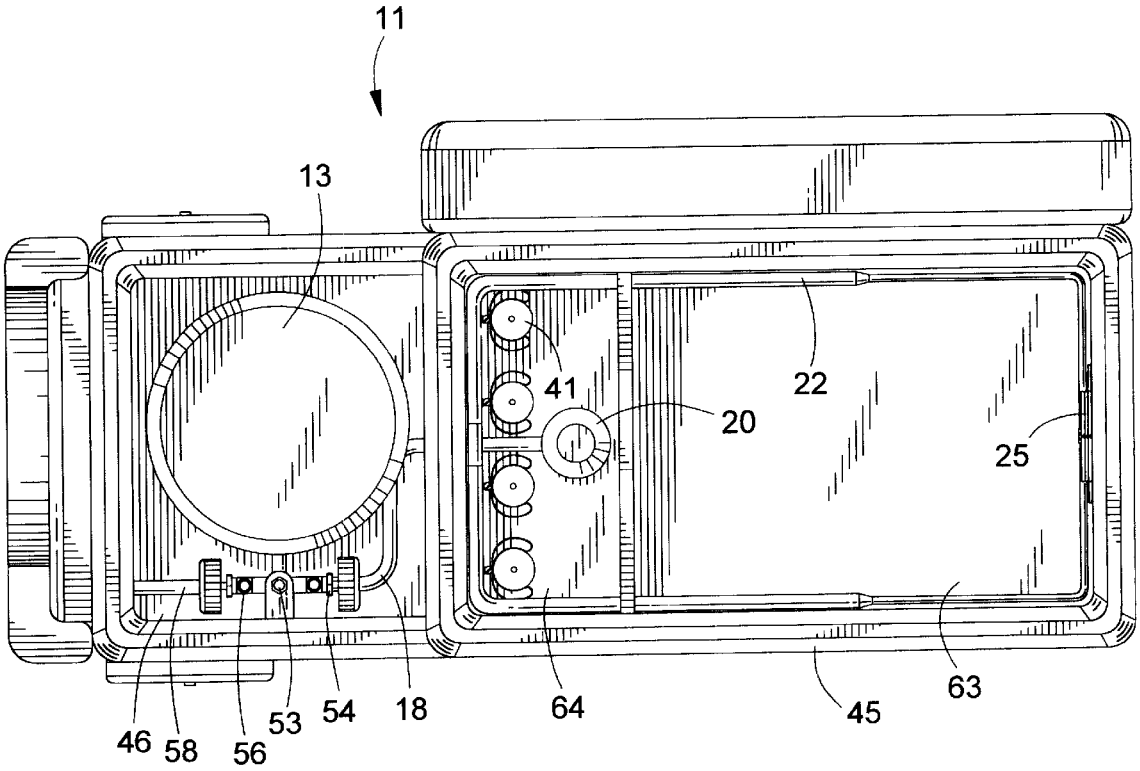
FIG. 6 is a top view of a cooling apparatus, according to an embodiment of the invention.
Figure 7A:
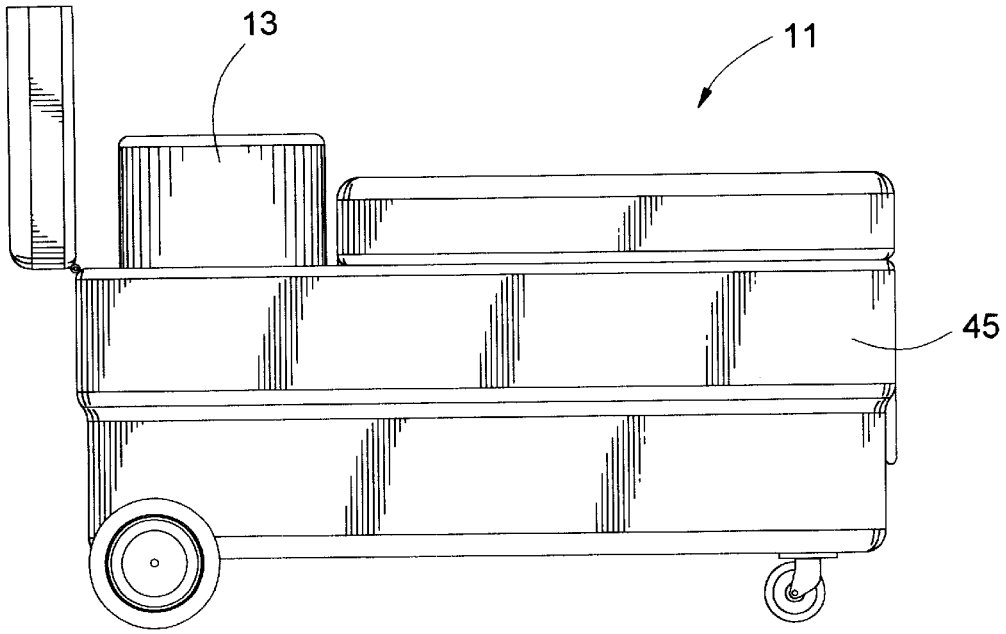
FIG. 7A is a side view of a cooling apparatus, according to an embodiment of the invention.
Figure 7B:
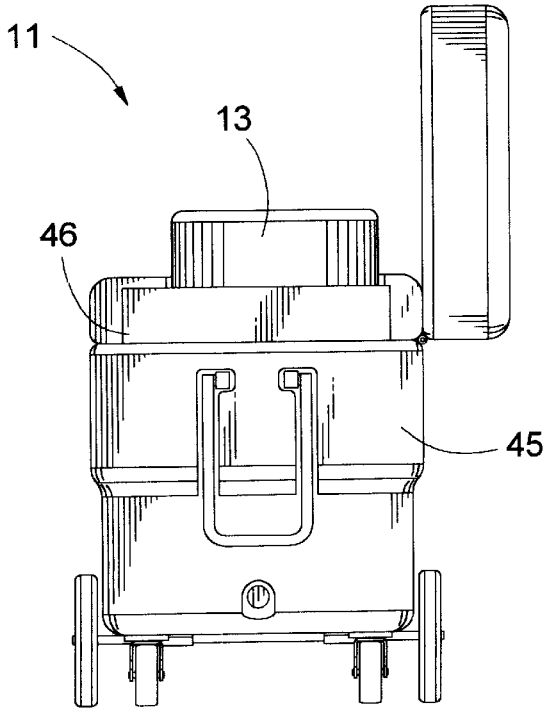
FIG. 7B is an end view of a cooling apparatus, according to an embodiment of the invention.
Figure 8A:
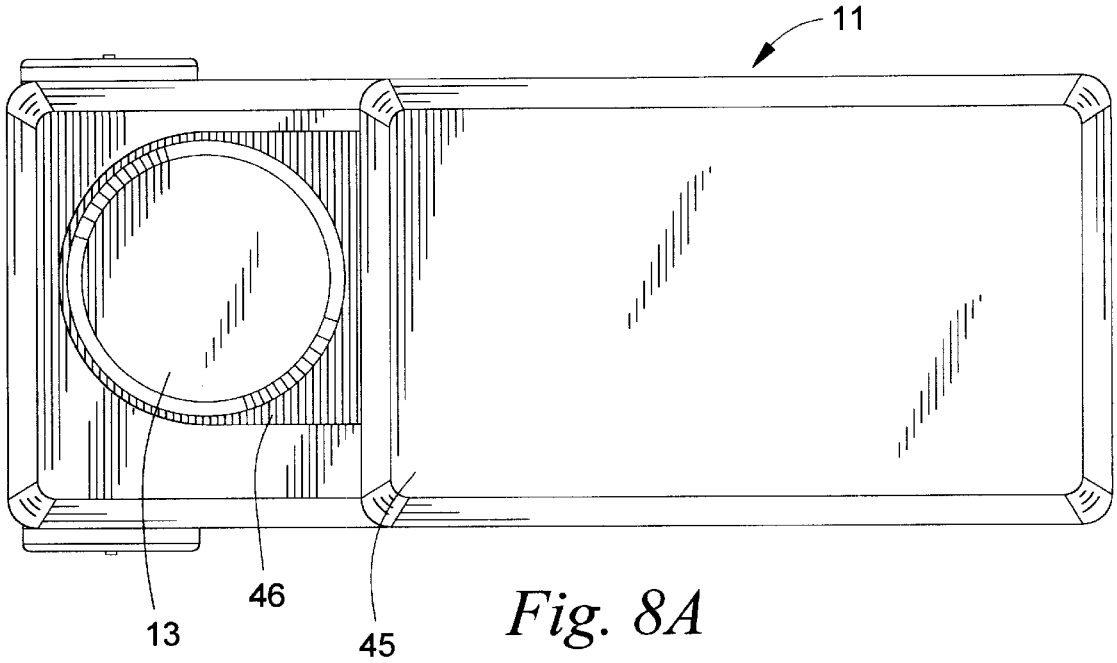
FIG. 8A is a top view of a cooling apparatus, according to an embodiment of the invention.
Figure 8B:
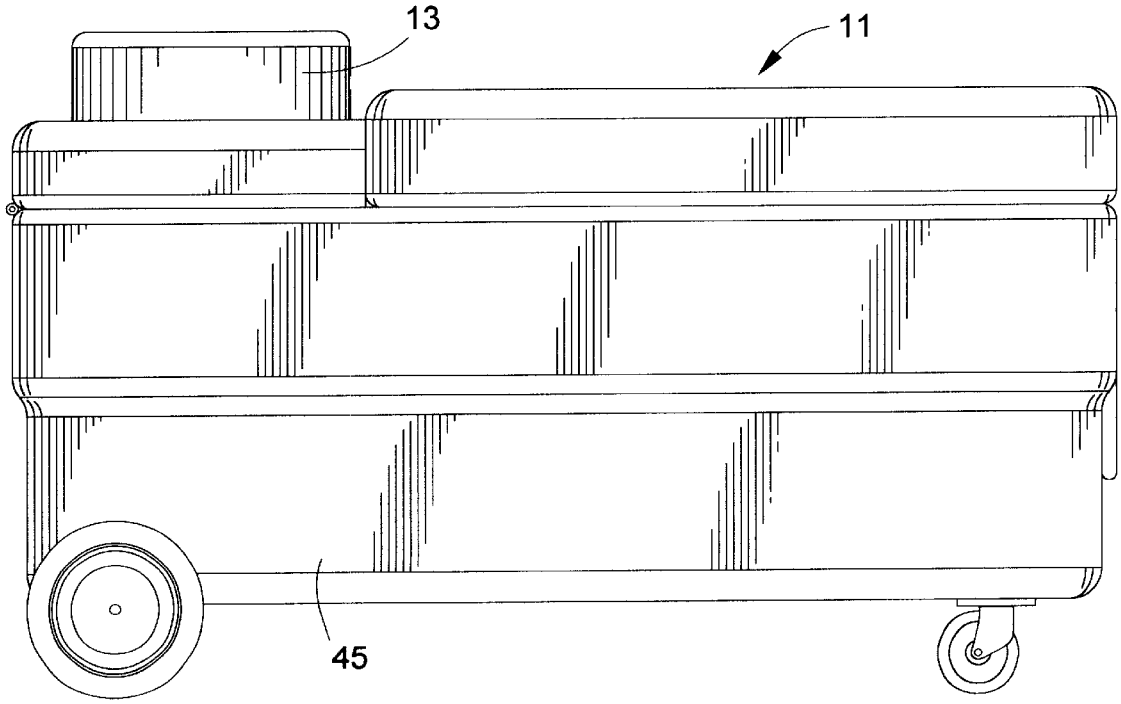
FIG. 8B is a side view of a cooling apparatus, according to an embodiment of the invention.

Furthermore, for a preferred embodiment illustrated in FIGS. 4 through 6, the tank 13 is preferably mounted within the tank compartment 46 of the ice chest 45 in an inverted position. As shown in FIGS. 4 and 5, the tank includes a tank valve 50 that connects to the supply line 18. The tank valve is most preferably enclosed by a valve cup 51, to prevent an inadvertent impacts or damage to the tank valve. The connection between the tank valve and the supply line is preferably a standard, reverse threaded attachment, but can alternatively be a proprietary connection, to encourage the use of tanks from a particular provider. Additionally, a simple counter-balanced spring mechanism can be attached to the tank to indicate the filled level of the tank.

Figure 9A:
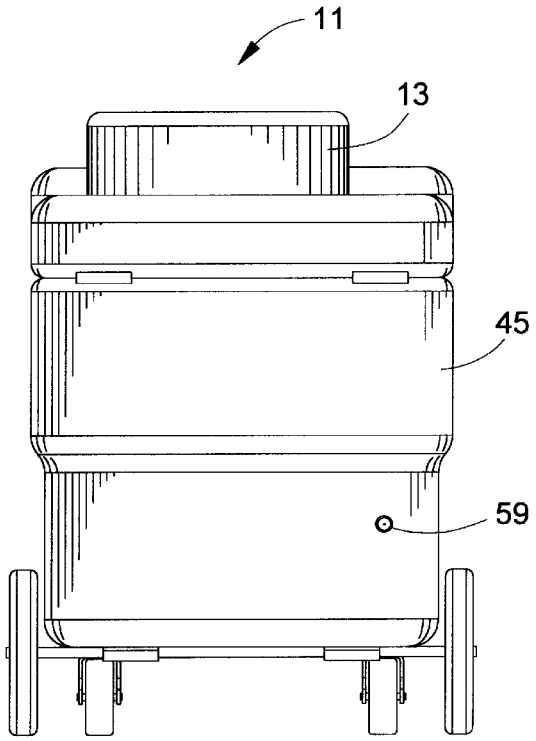
FIG. 9A is an end view of a cooling apparatus, according to an embodiment of the invention.
Figure 9B:
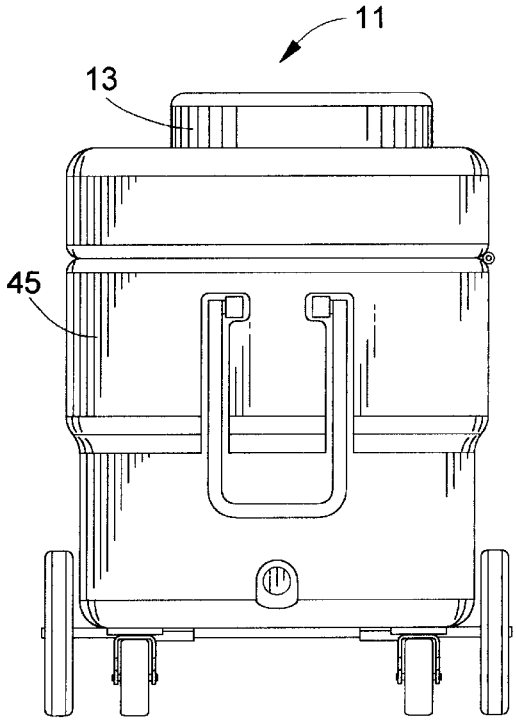
FIG. 9B is an end view of a cooling apparatus, according to an embodiment of the invention.
Figure 10:
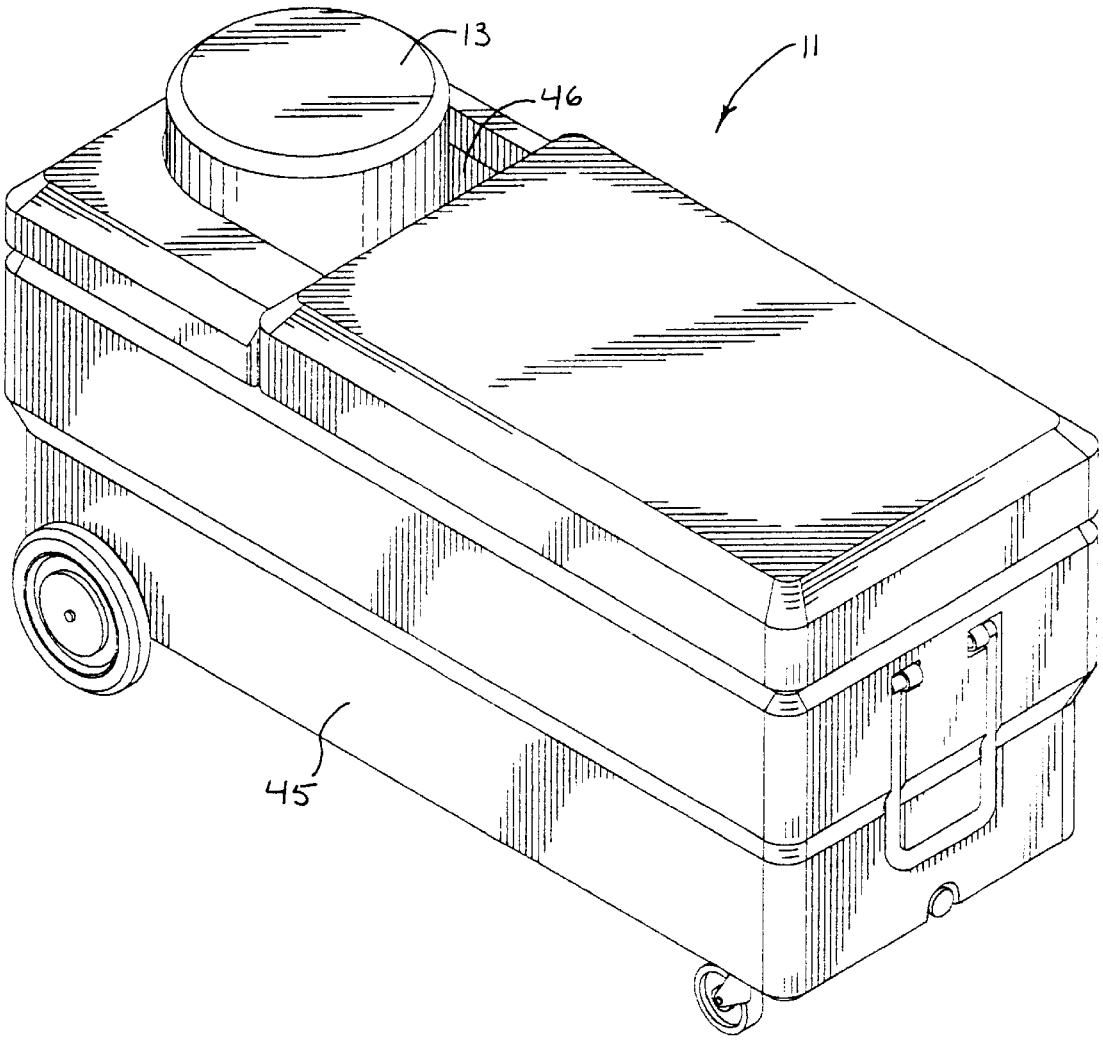
FIG. 10 is a perspective view of a cooling apparatus, according to an embodiment of the invention.

Additionally, in a preferred alternative of the cooling system 11, a valve manifold 53 can be installed along the supply line 18. As detailed in FIG. 5, the valve manifold can include a shut-off valve 54 that is easily accessed to manually stop the flow of liquid $CO_2$ 30 to the regulator 20. The valve manifold can also include an auxiliary valve 56, connected to an auxiliary supply line 58 and then to an auxiliary port 59. The auxiliary port can be utilized to fill additional cooling coil equipped devices, or any such device that requires liquid $CO_2$ 30. The auxiliary port is preferably located on the outer surface of the ice chest 45, as shown in FIGS. 5 and 9A.

In an alternative embodiment of the refrigeration system 11, the bleeder tube 25 can be extended or vented to the exterior of the ice chest 45, if desired. The open end 26 of the bleeder tube can be routed to any position inside or outside of the ice chest. The exit $CO_2$ vapor 35 is.cool and can be employed to augment cooling in a particular area. In an enclosed area, the exit $CO_2$ vapor can be vented outside.

For the refrigeration system 11, the cooling coil 22 can be exposed within the cooling compartment 47, as shown in FIGS. 4 through 6, or embedded within the ice chest 45 or container itself, to prevent inadvertent damage to the cooling coil. Additionally, as an alternative, guards or raised areas can be formed within the cooling compartment to protect the cooling coil, if desired, to prevent damage to the cooling coils while maintaining heat transfer to the coils.

A partition 62 can also be included within the cooling compartment 47 of the ice chest 45, as shown in FIGS. 4 through 6. The partition separates the cooling compartment into zones of differing temperature. Most preferably, one such zone is a freezing zone 63 located proximate to the regulator 20. On the other side of the partition, a cooling zone 64 is formed. For the cooling coil 22 configuration shown in FIGS. 4 through 6, the portion of the cooling coil within the freezing zone receives more liquid $CO_2$ 30 in the charging of the cooling coil, and so retains more $CO_2$ snow 33. Therefore, the freezing zone portion of the cooling coil has a higher cooling rate than the remainder of the cooling compartment, in the cooling zone. The ice maker tubes 40 are most preferably located in the freezing zone. The partition can be any material, preferably having a low heat transfer, and most preferably a transparent material, providing easy viewing of the contents of either zone of the cooling compartment.

The refrigeration system 11 of the present invention is simple to operate and easily portable. However, in enclosed areas, some caution must be used with the present invention in that the heavier than air $CO_2$ will displace oxygen and asphyxiation can result. For the smaller, portable systems employing the present invention, the quantities of $CO_2$ released are below a level of concern. The $CO_2$ released by the system is not combined with typical products of combustion, such as carbon monoxide, and so is considered less of an asphyxiation risk. However, in an enclosed or air tight space, and additionally with larger, typically commercial sized systems, caution should be used and adequate ventilation supplied.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

The following is claimed:

1. A cooling system utilizing a carbon dioxide refrigerant comprising:

a liquid carbon dioxide reservoir, the liquid carbon dioxide reservoir containing a quantity of carbon dioxide in a liquified state;

a regulator connected to the liquid carbon dioxide reservoir, the carbon dioxide flowable through the regulator, the regulator for reducing the pressure of the liquid carbon dioxide flowing through the regulator;

a cooling coil, the cooling coil for connecting the regulator to an atmosphere;

a flow of carbon dioxide established by a movement of the carbon dioxide from the liquid carbon dioxide reservoir, through the regulator, into the cooling coil, and to the atmosphere; and a plurality of solid carbon dioxide particles formed by a freezing of the carbon dioxide within the cooling coil, and the flow of the carbon dioxide into the cooling coil substantially blocked by the plurality of solid carbon dioxide particles within the cooling coil, the plurality of solid carbon dioxide particles sublimate-able to allow a re-establishment of the flow of carbon dioxide.

2. The cooling system of the claim 1, further comprising:

an ice maker, the ice maker including an ice maker tube attached to a bracket, the bracket mounted upon the cooling coil, and the ice maker tube fillable with water.

3. The cooling system of claim 1, wherein the cooling coil mounts within a cooling compartment and the refrigeration apparatus refrigerates the cooling compartment.

4. A refrigeration apparatus comprising:

a liquid carbon dioxide reservoir, the liquid carbon dioxide reservoir containing a quantity of carbon dioxide in a liquified state, the liquid carbon dioxide reservoir having a reservoir outlet, and the carbon dioxide releasable through the reservoir outlet;

a regulator having a regulator inlet and a regulator outlet, the reservoir outlet of the liquid carbon dioxide reservoir connected to the regulator inlet, the carbon dioxide flowable through the regulator, the regulator for reducing the pressure of the carbon dioxide flowing through the regulator;

a bleeder tube, the bleeder tube having a tube inlet end and a tube discharge end, the valve outlet of the regulator connected to the tube inlet end, and the tube discharge end open to an atmosphere;

a flow of carbon dioxide established by a movement of the carbon dioxide from the liquid carbon dioxide reservoir, through the regulator, into the bleeder tube, and to the atmosphere; and a plurality of solid carbon dioxide particles formed by a freezing of the carbon dioxide within the bleeder tube, and the flow of the carbon dioxide into the bleeder tube substantially blocked by the plurality of solid carbon dioxide particles within the bleeder tube, the plurality of solid carbon dioxide particles sublimate-able to allow a re-establishment of the flow of carbon dioxide.

5. The refrigeration apparatus of the claim 1, further comprising:

an ice maker, the ice maker including an ice maker tube attached to a bracket, the bracket mounted upon the cooling coil, and the ice maker tube fillable with water.

6. The refrigeration apparatus of claim 1, wherein the cooling coil mounts within a cooling compartment and the refrigeration apparatus refrigerates the cooling compartment.

7. A method for a refrigeration system utilizing a liquid carbon dioxide, including the steps of:

a) establishing a supply of the liquid carbon dioxide through a regulator to a cooling coil, the liquid carbon dioxide supplied from a carbon dioxide source, the regulator set to only allow flow below an initial cooling coil pressure;

b) forming a carbon dioxide snow by metering the liquid carbon dioxide through the regulator;

c) charging the cooling coil with the carbon dioxide snow;

d) plugging the cooling coil with the carbon dioxide snow by raising the pressure in the cooling coil above the initial cooling coil pressure to stop the supply of carbon dioxide into the cooling coil;

e) melting the carbon dioxide snow within the cooling coil with a cooling load external to the cooling coil to unplug the cooling coil and lower the pressure in the cooling coil below the initial cooling coil pressure; and f) re-establishing the supply of liquid carbon dioxide through the regulator.

* * * * *